US006089415A

United States Patent [19]

Terpstra et al.

[11] Patent Number: 6,089,415

[45] Date of Patent: Jul. 18, 2000

[54] VALVE FOR A PRESSURE CONTAINER

[75] Inventors: Willem Terpstra, Zeewolde; Jeroen Alexander Töpfer, Utrecht, both of Netherlands

[73] Assignee: Dispense Systems International B.V., Netherlands

[21] Appl. No.: 09/287,773

[22] Filed: Apr. 7, 1999

[30] Foreign Application Priority Data

Apr. 7, 1998 [NL] Netherlands ..... 1008828

[51] Int. Cl.[7] ..... B65D 83/00

[52] U.S. Cl. ..... 222/397; 137/212; 222/400.7

[58] Field of Search ..... 222/400.7, 400.8, 222/397, 1; 137/212, 322; 251/149.6

[56] References Cited

U.S. PATENT DOCUMENTS

| | | | |
|---|---|---|---|
| 4,363,336 | 12/1982 | Cerrato | 137/212 |
| 4,509,663 | 4/1985 | Fallon | 222/400 |
| 4,612,952 | 9/1986 | Fallon | 137/212 |
| 5,203,477 | 4/1993 | Lo | 222/153 |
| 5,636,657 | 6/1997 | Degenkolbe et al. | 137/212 |
| 5,713,496 | 2/1998 | Ipsen | 222/400.7 |

FOREIGN PATENT DOCUMENTS 2 192 621 1/1988 United Kingdom .

*Primary Examiner*—Kevin Shaver
*Assistant Examiner*—Melvin A. Cartagena
*Attorney, Agent, or Firm*—Westman, Champlin & Kelly, P.A.

[57] ABSTRACT

A valve for a keg of beer comprises a neck ring to be secured to the container and an inner part formed with a valve member, which fits an opening of the neck ring. A locking mechanism functions to lock the inner part in the neck ring, and a sealing ring forms a seal between the inner part and the neck ring at the location of opposite seat portions in the neck ring and the inner part. The inner part and the neck ring are provided with mutually cooperating coupling mechanisms, which, after the locking mechanisms have been released, provide for the removal of the inner part from the neck ring in two steps, wherein pressure relief takes place in the first step via at least one pressure relief opening. The pressure relief opening is formed through the wall of the neck ring, at a location a small distance above the seat portion in the neck ring, so as to effect a reliable pressure relief.

8 Claims, 2 Drawing Sheets

VALVE FOR A PRESSURE CONTAINER

BACKGROUND OF THE INVENTION

1. Field of the Invention

The invention relates to a valve for a pressure container, such as a keg of beer, according to the preamble of claim 1.

2. Description of the Related Art

Such a valve is known, e.g. from U.S. Pat. No. 4,509,663 and GB-B-2 192 621. With both valves, the pressure relief opening is formed by the gap that has formed as a result of play between the inside of the neck ring and the outside of the inner part. According to GB-B-2 192 621, said gap is 0.02–1.0 mm wide, which should be enough to provide a sufficiently quick pressure relief. However, there is a danger that the sealing ring which is disposed in said gap will seal the gap as a result of being pressed upwards and becoming wedged in said gap upon movement of the inner part during the first step. With the valve according to said British patent an additional cam is indeed provided on the inner side of the neck ring, which cam should at least partially prevent said phenomenon from occurring, but in practice it has become apparent that in some situations, in particular at high pressures, the sealing ring nevertheless seals the passage between the pressure ring and the inner part in such a manner that this interferes with the pressure relief.

SUMMARY OF THE INVENTION

The object of the invention is to eliminate this problem or to alleviate it to a considerable degree.

In order to accomplish that objective, the valve according to the invention is characterized in that the pressure relief opening is formed through the wall of the neck ring, at a location a small distance above the seat portion in the neck ring.

As a result of this, the gas from the container no longer needs to escape through the narrow gap between the neck ring and the inner part, but it can exit to the outside via a direct route through a pressure relief opening that has been specially formed in the wall of the neck ring for that purpose. The opening may be large enough to provide a quick pressure relief, without this having an adverse effect on the operation of the valve.

Preferably., the distance from the pressure relief opening to the seat portion in the neck ring is such that the seat portion of the inner part is positioned at least approximately opposite said pressure relief opening after the first step of the removal of the inner part.

It is advantageous thereby if the pressure relief opening is provided at a location where the inside diameter of the wall of the neck ring is larger than the diameter of the seat portion in the neck ring.

As a result of this, the sealing ring cannot seal the space between the neck ring and the inner part at the location of the pressure relief opening in some manner or other, since the interstice is larger than the radial thickness of the sealing ring.

Furthermore it is very advantageous if at least one passage opening is provided in the inner part, at a location under the seat portion in said inner part, which passage opening provides an (additional) passage between the container and said pressure relief opening.

As a result of the presence of said passage opening or passage openings, the gas no longer needs to escape through the space between the inner side of the neck ring and the outside of the inner part, but it can directly flow from the interior of the inner part, through a relatively large passage opening, to the wider gap between the neck ring and the inner part and subsequently through the pressure relief opening to the outside. Also in the event of the sealing ring being stuck at the location of the seat portion in the neck ring, gas can escape from the pressure container, since the upper side of the passage opening after the first step of the removal of the inner part will be positioned at a higher level than the upper side of the seat portion in the neck ring.

The invention will be explained in more detail hereafter with reference to the drawing, which shows an embodiment of the valve according to the invention.

DESCRIPTION OF THE PREFERRED EMBODIMENTS

Figure 1:
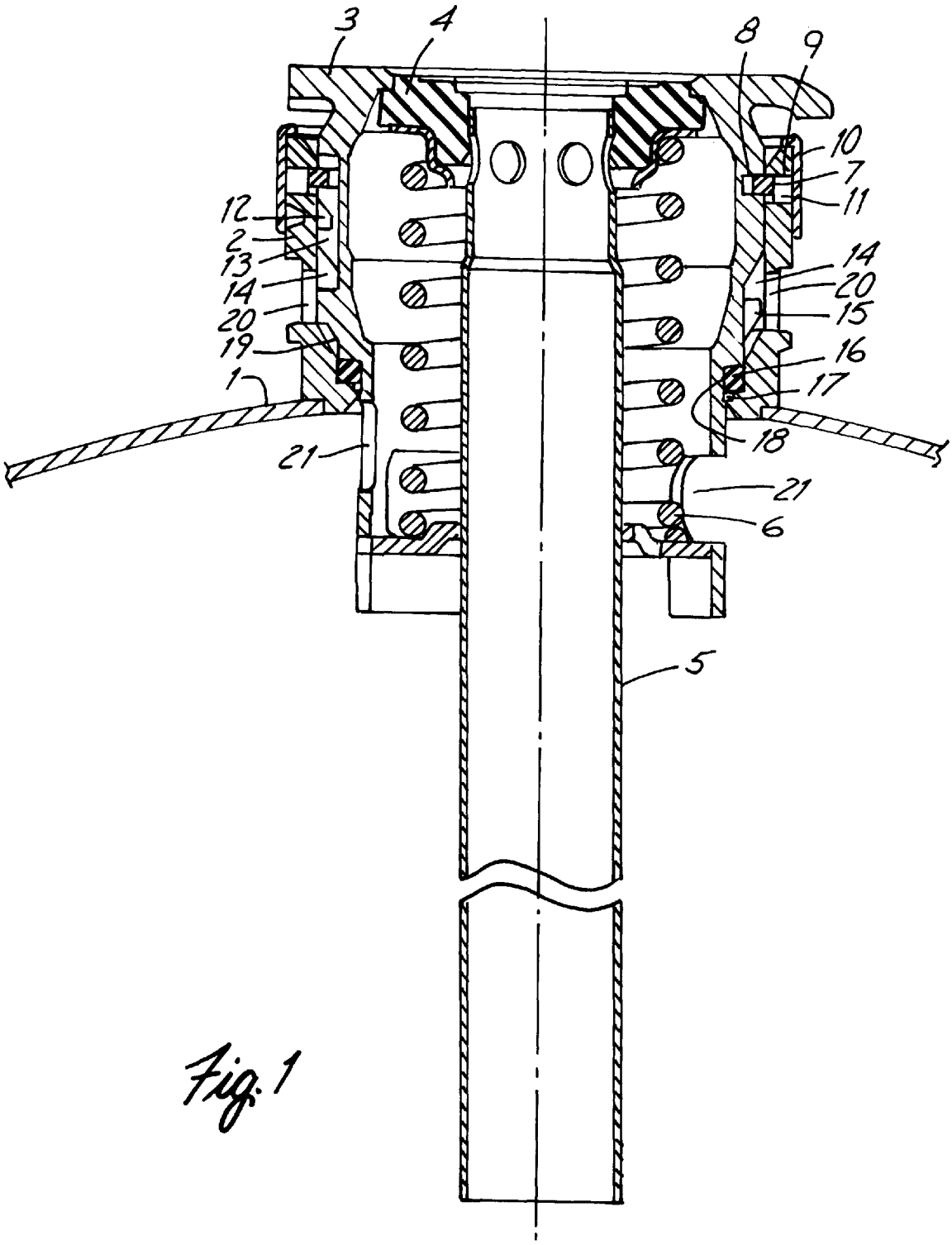
FIG. 1 is a vertical sectional view of an embodiment of the valve according to the invention in a state mounted on a pressure container.

It is noted that the terms above and under are used herein in relation to a vertically positioned valve. In case of a horizontally positioned valve, said terms will be changed accordingly.

The drawing shows the embodiment of the valve according to the invention as it is mounted on a pressure container. An upper part of said pressure container is schematically indicated with reference numeral 1. Said pressure container is preferably a keg of beer or of other beverages, in particular carbonated beverages, but it may also be intended for containing other liquids or gases under pressure.

In the illustrated embodiment, the valve comprises a neck ring 2, which may or may not be permanently secured to container 1, and a removable inner part 3. Said inner part 3 contains the valve member 4 (in the form of a non-return valve) and a tap shank 5 mounted thereon and a return spring 6. A coupling of a tap installation may be connected to the valve. These parts do not form part of the invention and they will not be explained in more detail herein.

In some cases there will be a desire to remove the inner part 3 of the valve, for example for cleaning or replacing the inner part, and to this end inner part 3 is detachably mounted. Inner part 3 is normally secured in neck ring 2 by means of a locking ring 7, which is received in an exterior or interior circumferential groove 8, 9, respectively, in inner part 3 and neck ring 2. Locking ring 7 must be forced into the exterior circumferential groove 8 of the inner part 3, via the openings 11 which are normally covered by a plastic cover 10, by means of a special tool so as to release the locking engagement by locking ring 7, after which inner part 3 can move outwards.

As a superpressure may prevail in the container at the time of the removal of the inner part 3, a provision for safety has been made, which prevents the inner part 3 from being forcefully shot out of the neck ring upon release of the locking engagement, causing damage or personal injury. To this end, the neck ring 2 and the inner part 3 are provided with mutually cooperating coupling means, which cooperate in such a manner that, after the locking of the inner part 3 by locking ring 7 has been released, the inner part 3 can be removed from the neck ring only in two separate steps, with pressure relief of the interior of container 1 taking place during the first removal step. In the illustrated embodiment, the coupling means consist of at least one cam 12 projecting on the inner side of neck ring 2, a first axial groove 13 formed externally on inner part 3, a circumferential groove 14 connected to the underside of axial groove 13, and a second axial groove 15 formed on the outside of inner part 3, which is open on the underside and which connects to circumferential groove 14 at the upper side, which groove is displaced an angle in circumferential direction with respect to the first, upper axial groove 13. The three grooves 13, 14, 15 form a stepped path for cam 12, which path said cam can follow upon a first axial movement of inner part 3, a following rotation of inner part 3, and a subsequent second axial movement. After the first step, cam 12 strikes against the underside of circumferential groove 14, and in this position of inner part 3 it must be possible for the pressure to escape from container 1.

In a mounted state, the space between neck ring 2 and inner part 3 is sealed gastight and fluid-tight by means of a sealing ring 16, in this case a rubber O-ring, which is retained between mating seat portions 17 and 18 in neck ring 2 and inner part 3, respectively. In a mounted state, the seat portions 17, 18 in the two parts 2 and 3 consist of opposite surfaces, which define an annular space, in which sealing ring 16 is compressed, in such a manner that a proper sealing effect is achieved. A diverging wall portion 19 abuts seat portion 17 on the inner side of neck ring 2, at the location where the inside diameter of neck ring 2 increases in upward direction from seat portion 17.

According to the invention, one or more pressure relief openings 20 are formed through the wall of the neck ring 2, in this case directly above diverging wall portion 19, to enable pressure relief, which pressure relief openings function to ensure that gas can escape from pressure container 1 after the first step of the removal of inner part 3. Furthermore, passage openings 21 are formed through the wall of inner part 3. The construction of inner part 3 is such that the underside thereof is open, so that the interior of said inner part is in communication with the interior of container 1.

Figure 2:
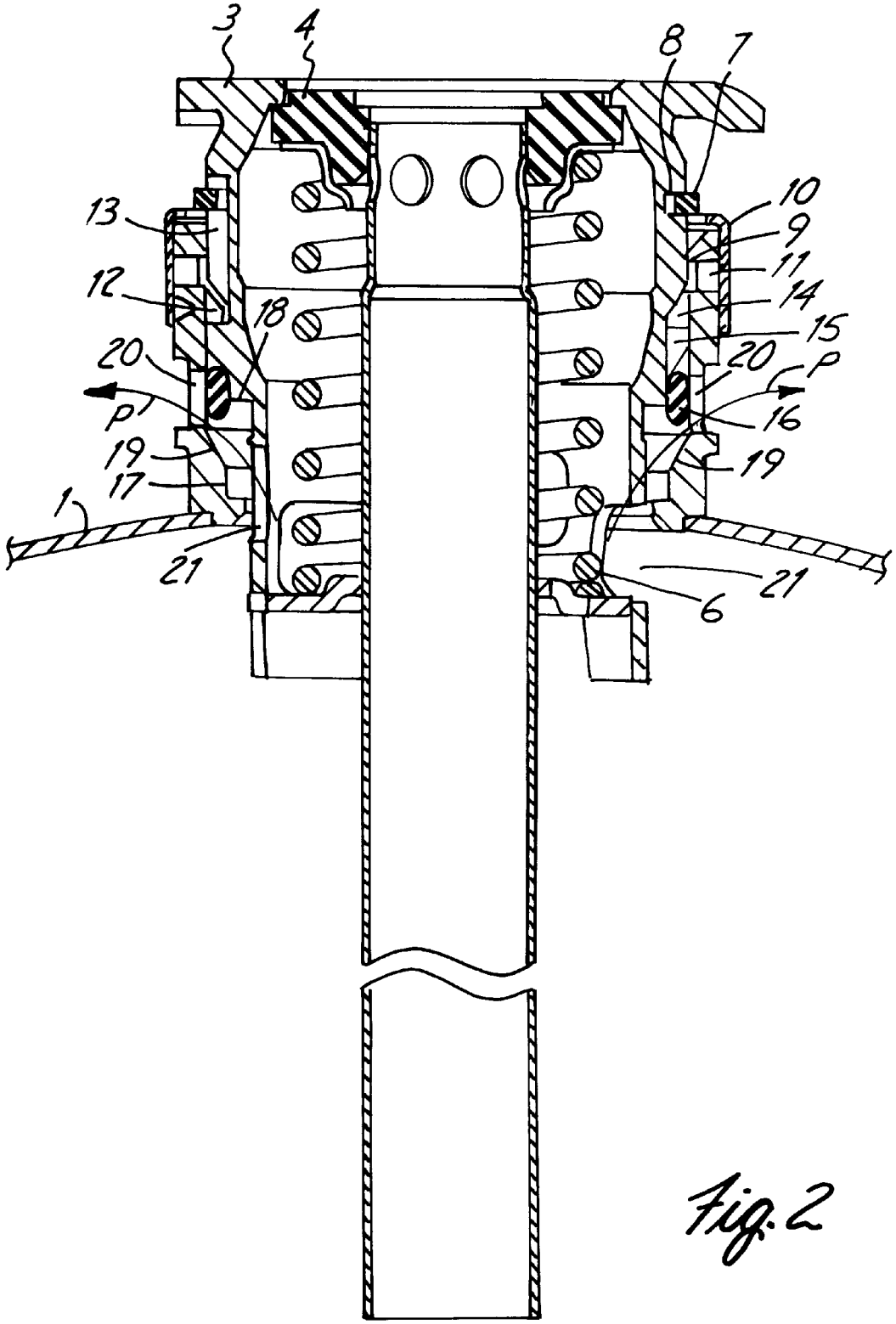
FIG. 2 is a sectional view corresponding to FIG. 1, wherein the inner part of the valve is shown in a position after the first step of the removal of the inner part from the neck ring.

FIG. 2 shows the position of inner part 3 after the first step of the removal thereof from neck ring 2, with arrows P indicating the route along which gas can escape from container 1 to the outside. As the figure shows, the pressure from container 1 has forced sealing ring 16 out of seat portion 17, but also out of seat portion 18, into a constriction between inner part 3 and neck ring 2, as a result of which the gap between parts 2 and 3 is closed, so that gas from container 1 can no longer escape via said gap. As a result of the provision of pressure relief openings 20 a small distance above seat portion 17 in neck ring 2, gas can still escape easily from container 1, either via the interior of inner part 3, the interstice between inner part 3 and neck ring 2 and then through pressure relief opening 20, or through the gap between inner part 3 and the underside of neck ring 2 and said interstice to pressure relief openings 20. Also in the event that sealing 16 should remain in its position at the location of seat portion 17 of neck ring 2, gas can still escape from container 1 because the upper side of passage openings 21 in inner part 3 is positioned at a higher level, in the position shown in FIG. 2, than the upper side of seat portion 17, so that gas can escape along the upper side of sealing ring 16. As a result of the presence of diverging wall portion 19, an annular space is formed in the space between neck ring 2 and inner part 3, in the area between the upper side of passage openings 21 and the underside of pressure relief openings 20, the radial width of which is such that said annular space cannot be sealed in any position by sealing ring 16, and a proper pressure relief can be ensured in any case. The upper surface of the seat portion 18 in inner part 3 will be positioned above the underside of pressure relief openings 20 after the first removal step, so that the seat portion 18 of inner part 3 will be positioned approximately opposite pressure relief openings 20.

From the foregoing it will be apparent that the invention provides a valve or a coupling for a pressure container which excels by its safety and reliable operation.

The invention is not limited to the above-described embodiment as shown in the drawing, which can be varied in several ways within the scope of the invention. Thus, the coupling parts of neck ring 2 and inner part 3 can be mutually exchanged. Furthermore, additional grooves and/or cams may be provided, or other elements may be utilized. Inner part 3 may also be made up of more than one part. Furthermore it is possible to form the pressure relief opening directly above the seat portion in the neck ring, or to form a groove leading to the pressure relief opening in the wall of the neck ring. The cover of plastic material may be continued to above the pressure relief openings, so as to prevent the penetration of dirt. All kinds of other variations are possible.

We claim:

1. A valve for a pressure container, comprising:

a neck ring (2) to be secured to the container (1);

an inner part (3) formed with a closing member (4) which fits an opening of the neck ring;

locking means (7–9) for locking the inner part in the neck ring; and at least one sealing ring (16) for forming a seal between said inner part and said neck ring at the location of opposing seat portions (17, 18) in said neck ring and said inner part;

wherein said inner part and said neck ring are provided with mutually cooperating coupling means (12–15), which, after the locking means have been released, provide for the removal of said inner part from said neck ring in two steps, wherein pressure relief takes place in the first step, via at least one pressure relief opening (20), which is formed through the wall of said neck ring at a location above the seat portion in said neck ring.

2. A valve according to claim 1, wherein said distance from the pressure relief opening (20) to the seat portion (17)

in the neck ring (2) is such that the seat portion (18) of the inner part (3) is positioned at least approximately opposite said pressure relief opening (20) after the first step of the removal of the inner part.

3. A valve according to claim 1, wherein said pressure relief opening (20) is provided at a location where the inside diameter of the wall of the neck ring (2) is larger than the diameter of the seat portion (17) in said neck ring.

4. A valve according to claim 3, wherein the inside diameter of said neck ring (2) increases from said seat portion (17) via a diverging wall portion (19), whilst said pressure relief opening (20) adjoins said diverging wall portion.

5. A valve according to claim 1, wherein at least one passage opening (21) is provided in the inner part (3), at a location under the seat portion (18) in said inner part, which passage opening (21) provides an additional passage between the container (1) and said pressure relief opening (20).

6. A valve according to claim 1, wherein a number of pressure relief openings (20) are formed through the wall of said neck ring (2).

7. A valve according to claim 1, wherein the height of said pressure relief opening (20) is greater than the thickness of said sealing ring (16).

8. A pressure container, in particular a keg of beer, provided with a valve according to claim 1.

* * * * *

UNITED STATES PATENT AND TRADEMARK OFFICE

CERTIFICATE OF CORRECTION

PATENT NO. : 6,089,415
DATED : July 18, 2000
INVENTOR(S) : Willem Terpstra et al.

It is certified that error appears in the above-identified patent and that said Letters Patent is hereby corrected as shown below:

Title page,
Item [56] References Cited, U.S. PATENT DOCUMENTS,
Insert the following references:

| | | | |
|---|---|---|---|
| -- 3,939,860 | 2/1976 | Golding | 137/212 |
| 4,685,598 | 8/1984 | Nezworshki | 22/400.7 -- |

FOREIGN PATENT DOCUMENTS
Insert the follwing reference:
-- 0 142 966 A1 5/1985 EPO --.

Signed and Sealed this

Second Day of April, 2002

*Attest:*

*Attesting Officer*

JAMES E. ROGAN
*Director of the United States Patent and Trademark Office*